US005871120A

United States Patent [19]

Romero et al.

[11] Patent Number: 5,871,120

[45] Date of Patent: Feb. 16, 1999

[54] VACUUM STORAGE AND DISPENSING CONTAINER

[75] Inventors: Johnie Romero, Greenwell Springs, La.; Andrew R. Weber, Whitefish Bay, Wis.; Douglas B. Leeds, New York, N.Y.; Helene Paulson, New York, N.Y.; Arthur T. Sempliner, Douglaston, N.Y.

[73] Assignee: Community Coffee Company, Inc., Baton Rouge, La.

[21] Appl. No.: 802,470

[22] Filed: Feb. 19, 1997

Related U.S. Application Data

[63] Continuation-in-part of Ser. No. 425,932, Apr. 20, 1995, Pat. No. 5,669,528.

[51] Int. Cl.[6] ..... B67D 1/08

[52] U.S. Cl. ..... 222/53; 222/129; 222/152; 222/185.1; 222/449

[58] Field of Search ..... 222/53, 129, 152, 222/185.1, 444, 449; 99/275, 292

[56] References Cited

U.S. PATENT DOCUMENTS

| | | | |
|---|---|---|---|
| 1,936,857 | 11/1933 | Reisdorf | 222/152 |
| 2,662,664 | 12/1953 | Decker | 222/53 |
| 5,029,517 | 7/1991 | Sigmon | 222/444 |
| 5,088,626 | 2/1992 | Patton et al. | 222/449 |
| 5,669,528 | 9/1997 | Romero et al. | 222/53 |

*Primary Examiner*—Joseph A. Kaufman
*Attorney, Agent, or Firm*—J. M. (Mark) Gilbreth; Robert W. Strozier; Gilbreth & Stozier, P.C.

[57] ABSTRACT

A vacuum storage and dispensing container for use with perishable items, particularly food products, and more particularly for use with roasted whole-bean coffee in any retailing application, to extend shelf life of the perishable item. The invention includes a storage and dispensing container, and further includes a valve mechanism for opening the cylinder to the atmosphere. A merchandising unit for storing and dispensing perishables includes a plurality of the above described vacuum storage and dispensing containers.

5 Claims, 18 Drawing Sheets

VACUUM STORAGE AND DISPENSING CONTAINER

REATED APPLICATION DATA

This application is a continuation-in-part of U.S. patent application Ser. No. 08/425,932, filed Apr. 20, 1995 now U.S. Pat. No. 5,669,528.

FIELD OF THE INVENTION

The present invention relates to a vacuum storage and dispensing system. In another aspect, the present invention relates to a vacuum storage and dispensing system for use with perishable items, particularly food products. In even another aspect, the present invention relates to a vacuum storage and dispensing system for use with roasted whole-bean coffee, to extend the shelf life of the coffee for several months.

BACKGROUND OF THE INVENTION

Preservation of food is accomplished by controlling and, where if possible, destroying the agents of food spoilage. Food spoilage may be considered to be any organoleptic change—that is, any tactile, visual, olfactory, or flavor, or change that the consumer considers to be an unacceptable departure from the normal state. The agents of food spoilage are present in abundance, not only within food, but in the environments where foods are grown, harvested, processed, and stored. They can include microorganisms such as bacteria and mold or a wide variety of chemical and physical factors. Of particular importance are oxygen and moisture, which can degrade some food products in a short period of time. A number of preservation techniques, including canning, dehydration, refrigeration, the addition of chemical additives, and irradiation have been devised to stop the various kinds of food spoilage.

Ground coffee is one food product, for example, that is vacuum packed in order to maintain freshness for delivery to the consumer. Obviously, however, the coffee begins to loose freshness the moment the container is opened and the vacuum lost to the surrounding atmosphere, which is normally humid to a substantial degree, especially relative to the coffee. Because of this, consumers are demanding whole-bean coffee that they can grind in small portions just prior to brewing. Nevertheless, the delivery of roasted whole-bean coffee to consumers in a retail setting is plagued with difficulties, for whole-bean coffee is susceptible to gradual, but continuous, permeation of oxygen and moisture leading to staleness of the product.

Roasted whole-bean coffee is now sold in what is commonly known in the industry as atmospheric storage bins. They can include storage bins from which a customer fills coffee beans with the aid of a scoop (which can present sanitation problems), storage bins that offer a free-flow spout mechanism in the bottom, operated by a lever, or storage bins with a portion control device designed to dispense a predetermined amount of coffee beans.

In general, these coffee storage bins are designed to accomplish one basic objective: to make it easy to dispense the product.

Typically, a grocery store customer selects the desired coffee bean from an atomospheric storage bin, dispenses the coffee beans into a coffee grinder, grinds the coffee, and then takes the ground coffee beans home for personal use. Unfortunately, these atmospheric storage bins allow the entry of air and moisture, and when exposed to these elements, the roasted coffee beans quickly begin the gradual surrender of their rich aroma, freshness, and distinctive taste. These containers can also be opened by the customer and foreign objects inserted to contaminate the product, such that the consuming public is not always presented with fresh, pure coffee beans.

Thus, there is a need in the prior art for a more tamper resistant container for dispensing coffee beans and other food products.

There is another need in the prior art to provide a dispensing system for coffee or other perishable foods, designed so that these items are stored therein, relatively free from interaction with air and humidity, to preserve their freshness.

These and other needs in the prior art will become more apparent to those of skill in the art, upon review of this specification, claims and its drawings.

SUMMARY OF THE INVENTION

It is one object of the present invention to provide a more tamper resistant container for dispensing items which degrade when exposed to the atmosphere. Nonlimiting examples of which items include coffee, tea, nuts, dried fruits, foodstuffs in general, pharmaceuticals or film, or other perishable food items.

It is another object of the present invention to provide a dispensing system for items which degrade when exposed to the atmosphere. Nonlimiting examples of which items include coffee, tea, nuts, dried fruits, foodstuffs in general, pharmaceuticals or film or other perishable items. The system is designed so that these items are stored therein, relatively free from interaction with air and humidity, to preserve their freshness or chemical stability or integrity.

These and other objects of the present invention will become more apparent to those of skill in the art upon review of this specification, drawings and claims.

According to one embodiment of the present invention, there is provided a dispensing system, which includes at least one container storing under reduced atmospheric pressure the product to be dispensed. The system further includes a pressure reducing mechanism in communication with the container, for creating and maintaining a pressure differential within said container, said differential measured between the pressure inside and outside of said container. The system even further includes a product dispensing mechanism, activated and controlled by the user, for initiating temporary elimination of said pressure differential and for dispensing a portion of said product from said at least one container. The system still further includes a valve mechanism, operably associated with said product dispensing mechanism, for sequentially temporarily eliminating said communication between the pressure reducing mechanism from the container, temporarily eliminating said pressure differential, and dispensing said portion of said product. Finally, the system includes a flexible linkage, operably associated with said product dispensing mechanism and said valve mechanism, for closing said product dispensing mechanism to permit restoration of said pressure differential.

BRIEF DESCRIPTION OF THE DRAWINGS

The accompanying drawings, which are incorporated in and form a part of the specification illustrate only some of the many embodiments of the present invention, and, together with the description, serve to explain the principles of the invention. In the drawings.

Figure 1:
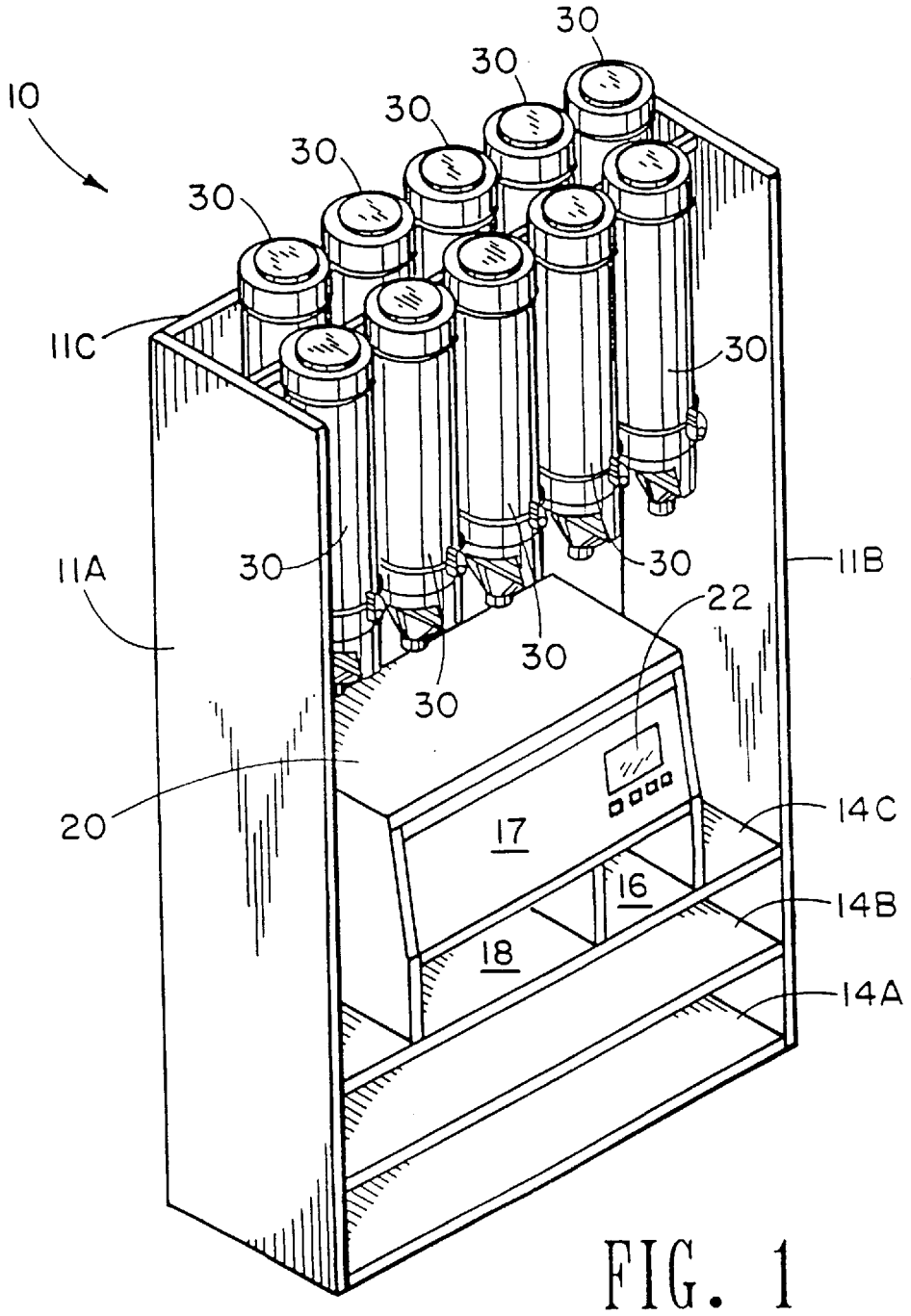
FIG. 1 is a pictoral representation of one embodiment of merchandising unit 10 of the present invention, showing the basic components of unit 10, including walls 11A, 11B and 11C, shelves 14A, 14B and 14C, and containers 30.

FIG, 2 is a front view of merchandising unit 10 of FIG. 1.

Figure 3:
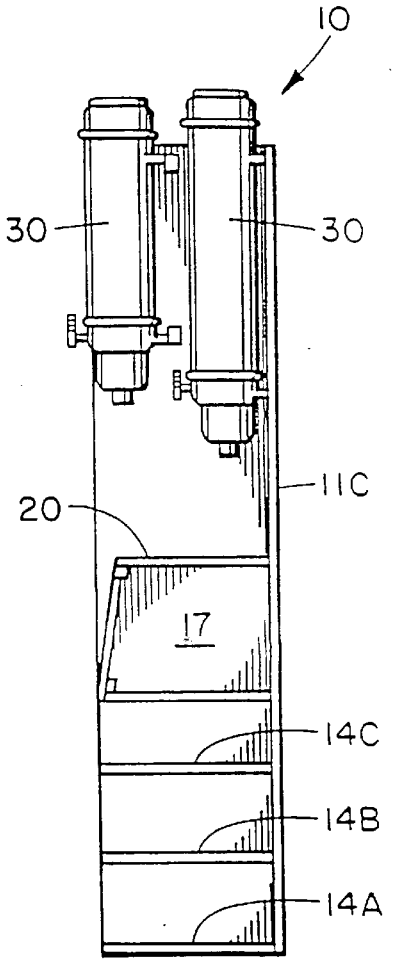

FIG. 3 is a cross-sectional side view of merchandising unit 10 of FIG. 1.

Figure 4:
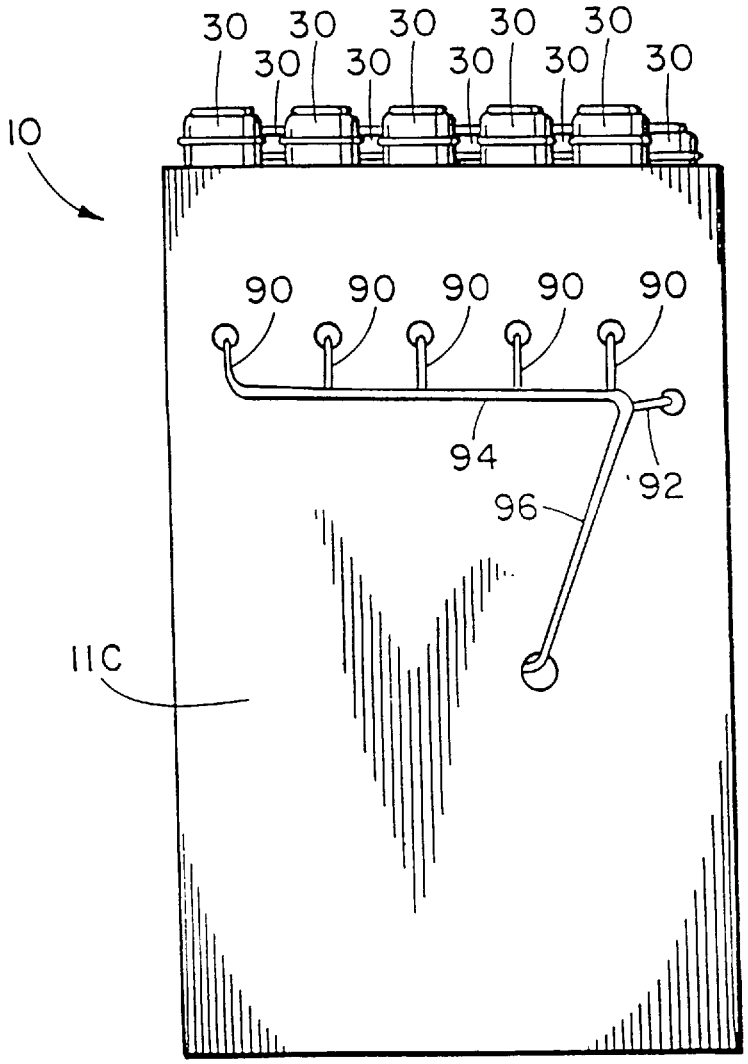

FIG. 4 is one embodiment of a rear view of merchandising unit 10 of FIG. 1.

Figure 5:
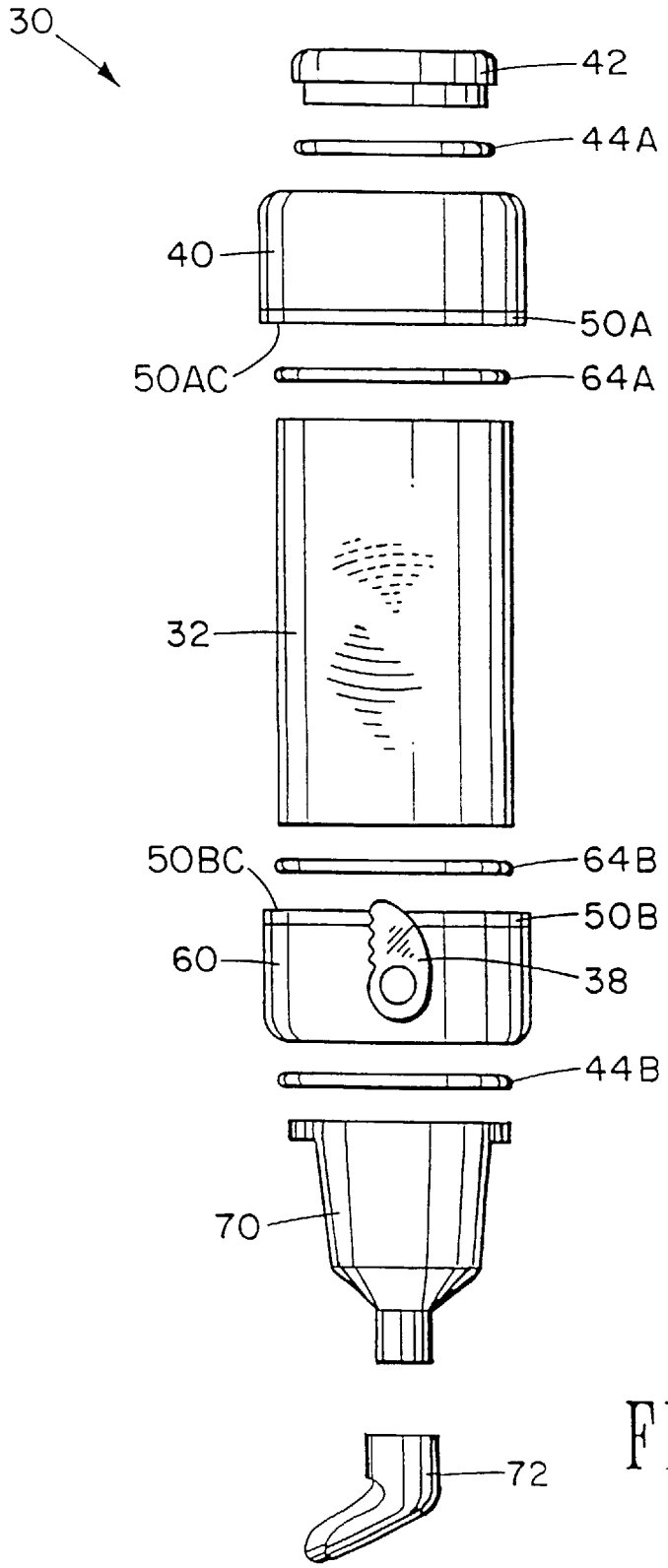

FIG. 5 is an exploded front view of container 30 of FIGS. 1–4, showing transparent, hollow, elongated cylinder 32, upper enclosure 40, lower enclosure 60, and dispensing snout 70, and diverter tongue 72.

Figure 6:
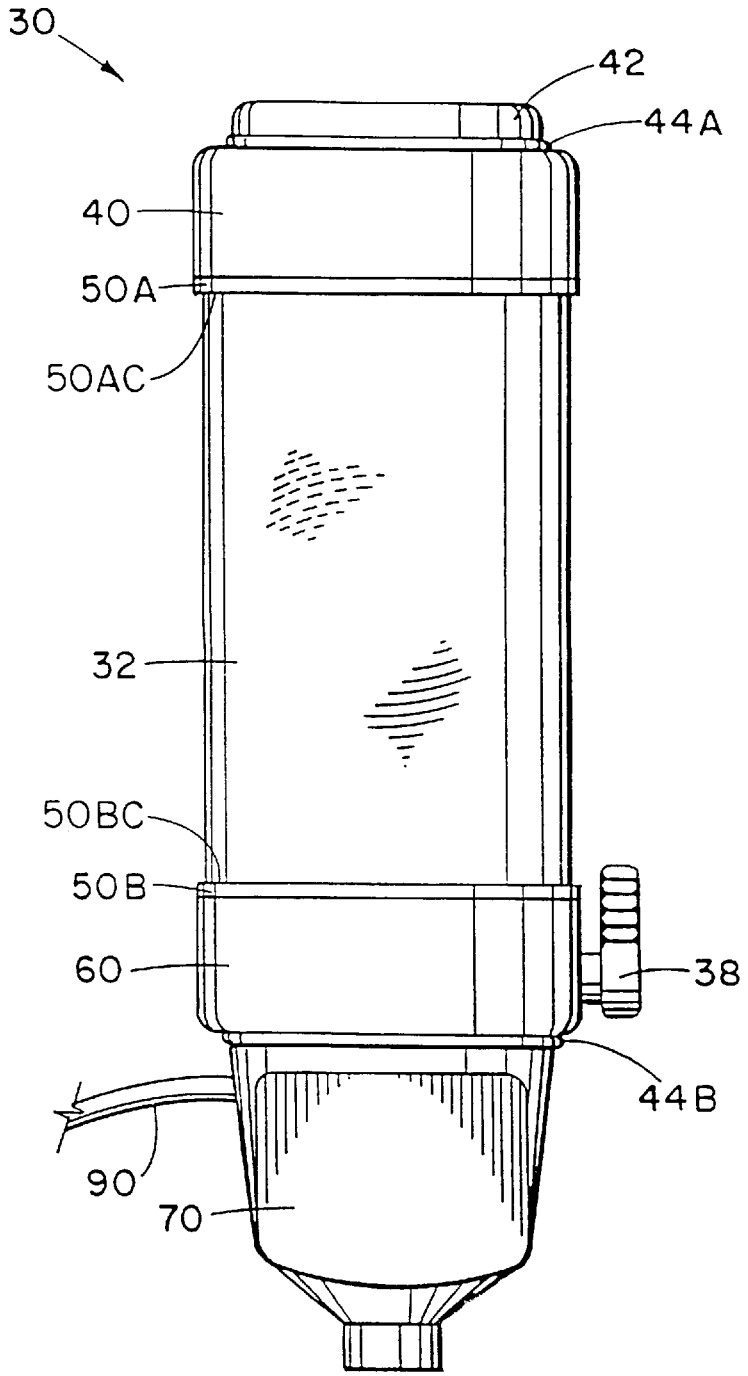

FIG. 6 is a left side view of container 30 of FIG. 5.

Figure 7A:
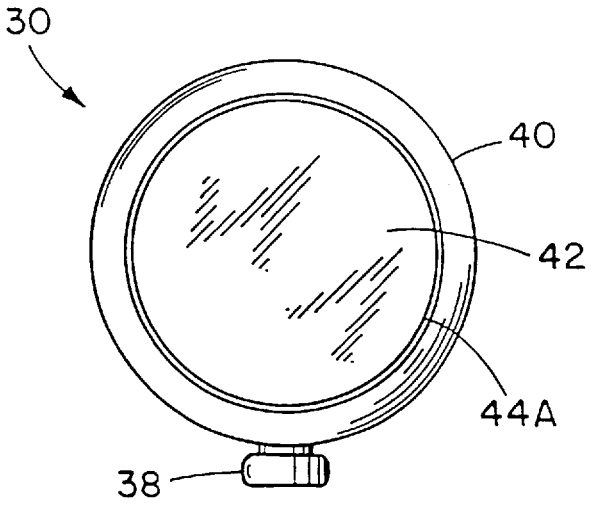

FIG. 7A is a top view of the container 30 of FIG. 5, showing handle 38, upper enclosure 40, lid 42, and O-ring 44A.

Figure 7B:
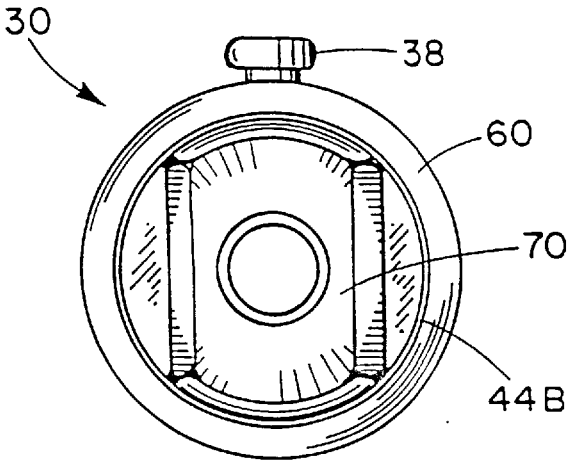
Figure 8A:
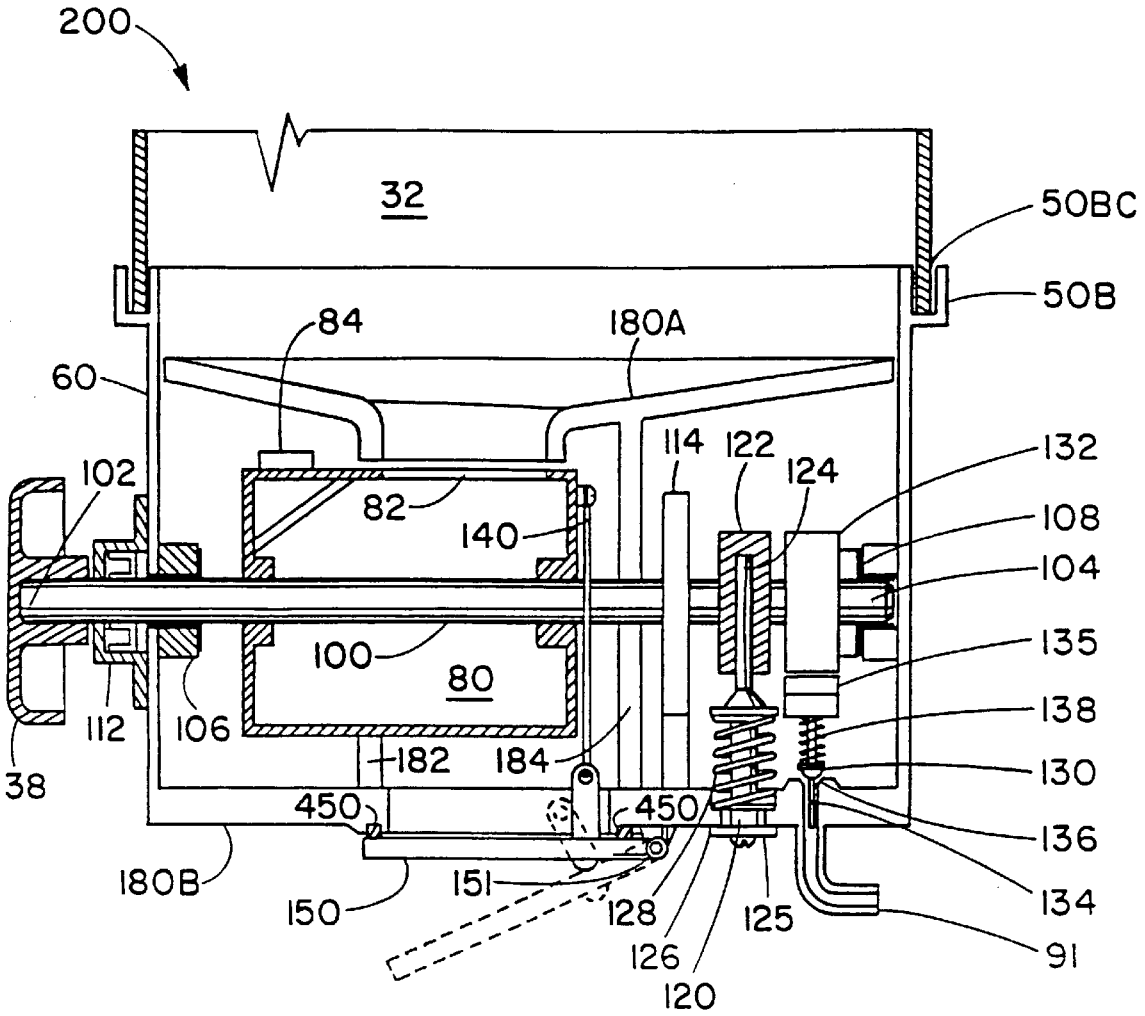
Figure 8B:
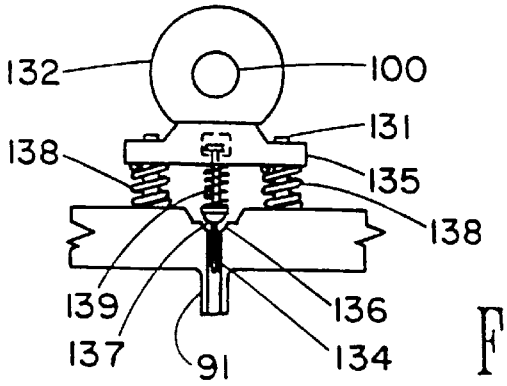

FIG. 7B is a bottom view of the container 30 of FIG. 5 showing the handle 38, lower enclosure 60, dispensing snout 70, and O-ring 44B;

FIG. 8 is a cross-sectional view of shaft 100, portion control bin 80, valves and cams, and dispensing door 150 of an embodiment of the present invention.

Figure 9:
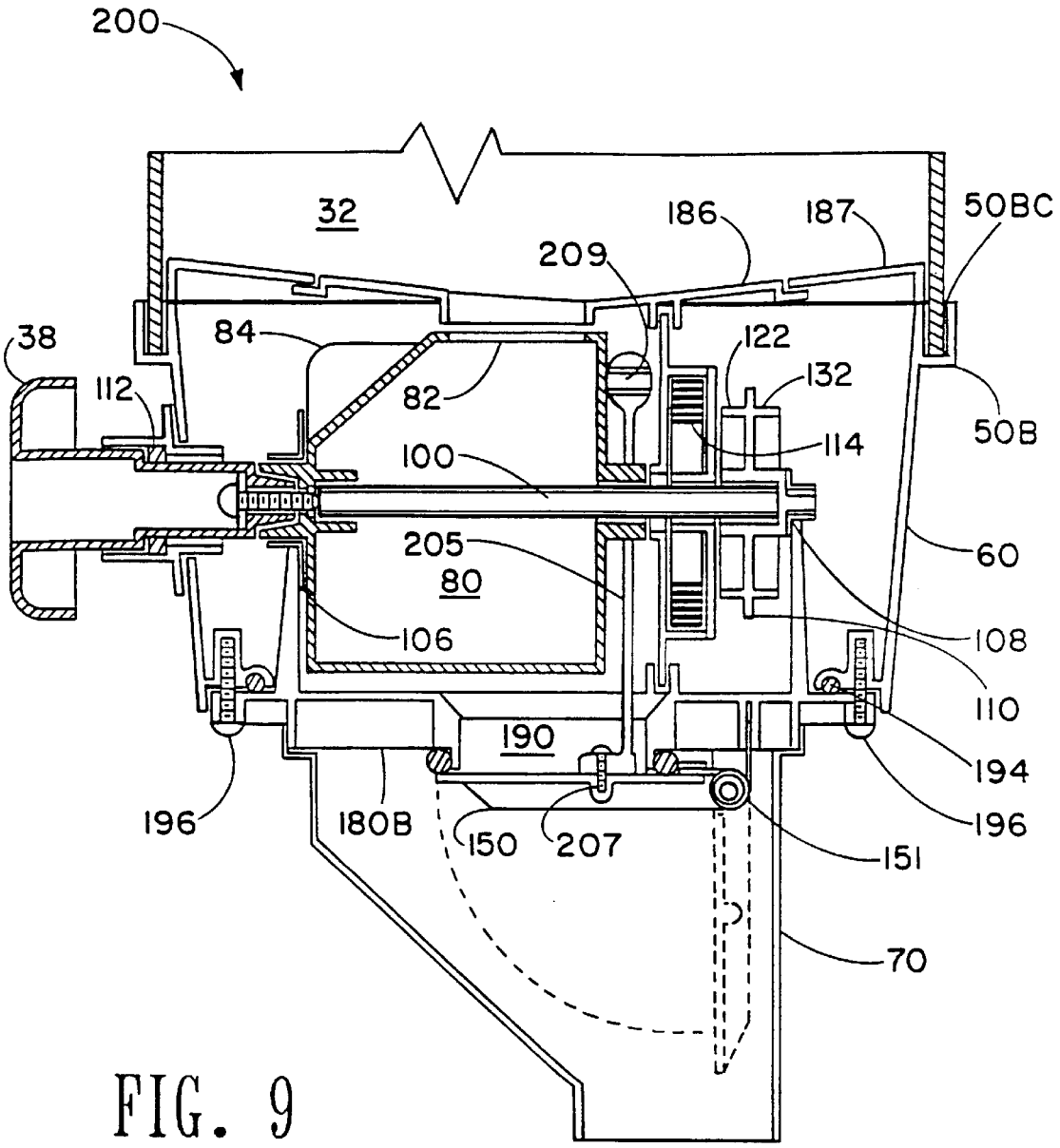

FIG. 9 is a cross-sectional view of the cylinder 32, lower enclosure 60, rotary shaft 100, portion control bin 80, and lower chassis plate 180B of another embodiment of the present invention.

Figure 10A:
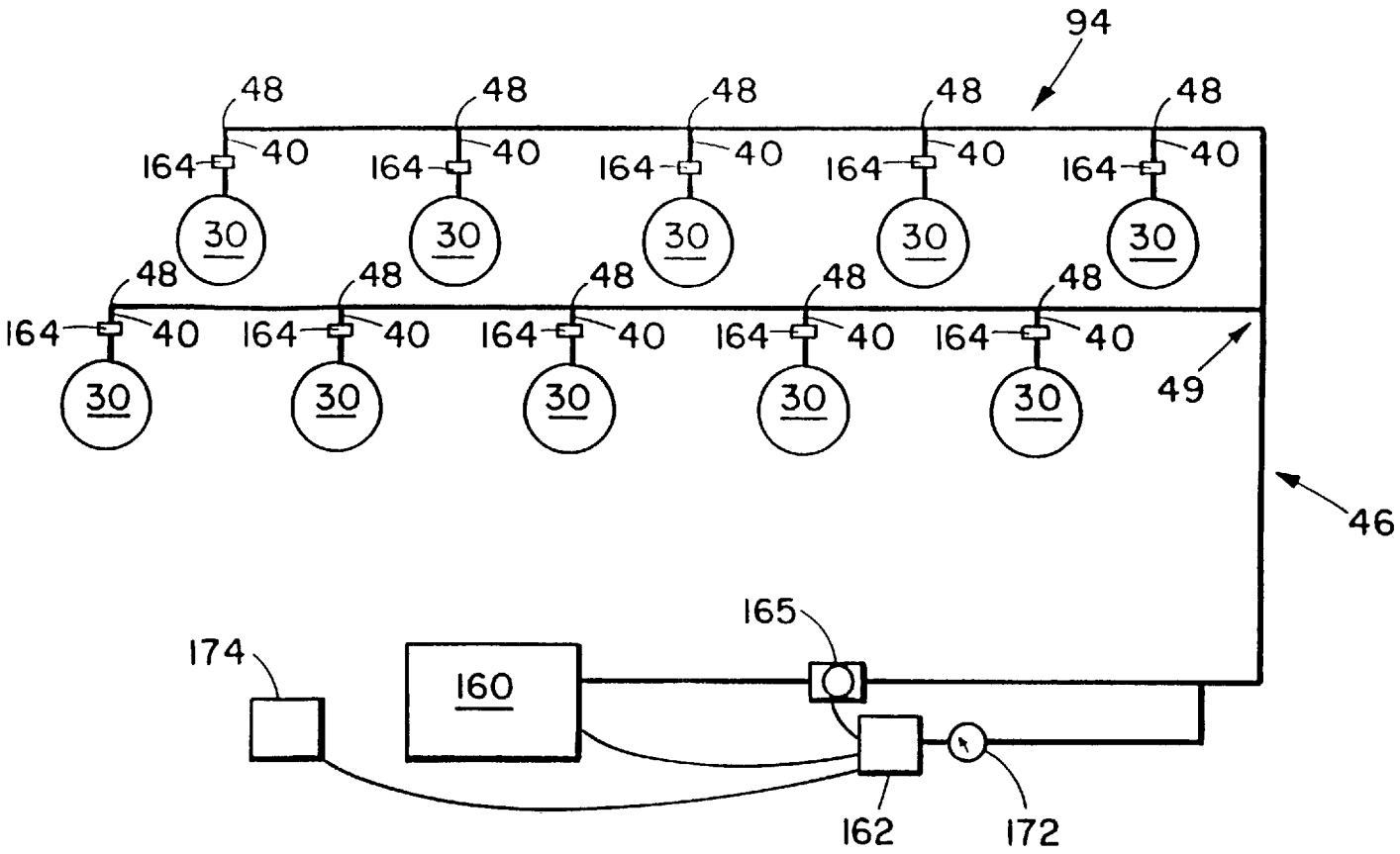

FIG. 10A is an alternative embodiment of a vacuum system for merchandising unit 10 of FIG. 1.

Figure 10B:
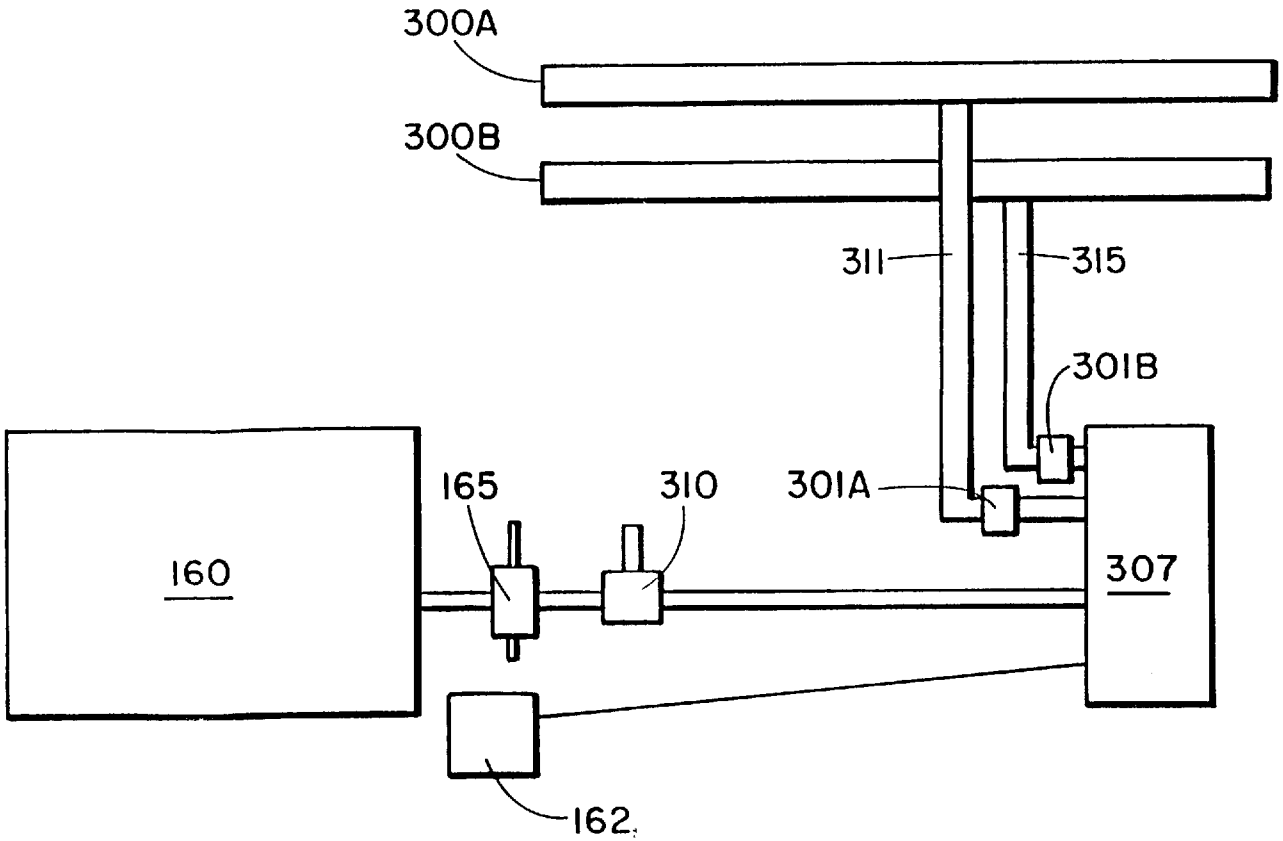

FIG. 10B is a schematic block diagram of another alternative embodiment of the vacuum system of the present invention.

Figure 11B:
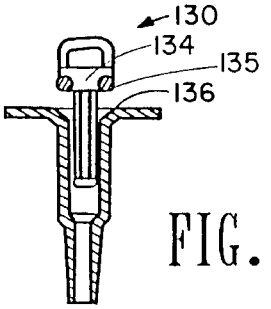
Figure 11C:
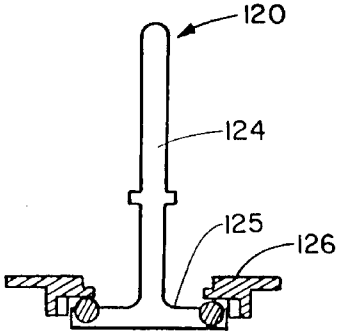
Figure 11A:
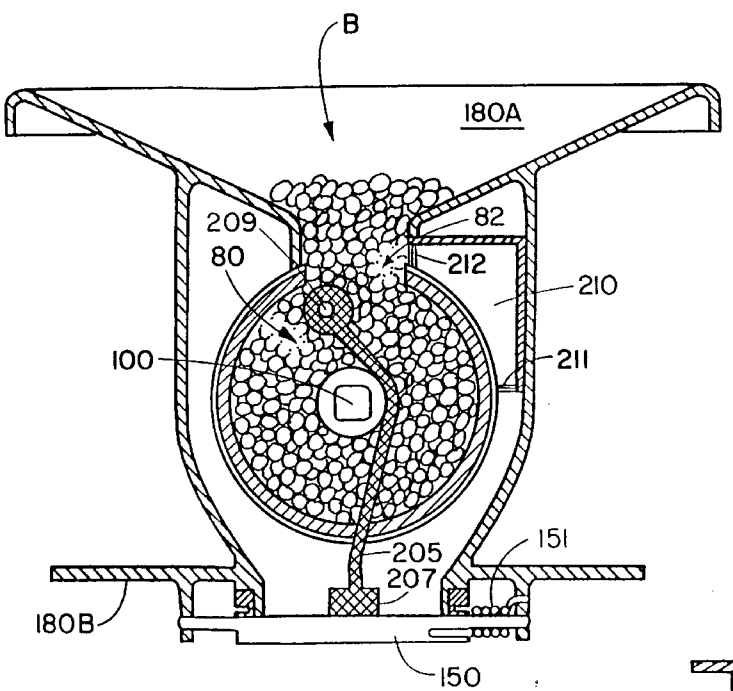

FIGS. 11A, 11B and 11C show for a first position of dispensing bin 30, a cross-sectional view of dispensing bin 80, a schematic of supply valve assembly 130, and a schematic of dump valve assembly 120, respectively.

Figure 12B:
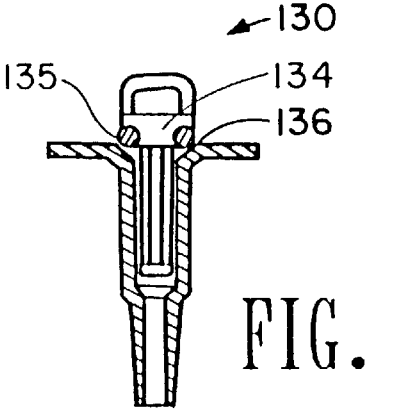
Figure 12C:
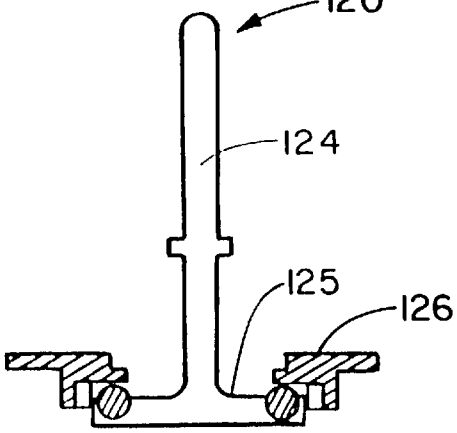
Figure 12A:
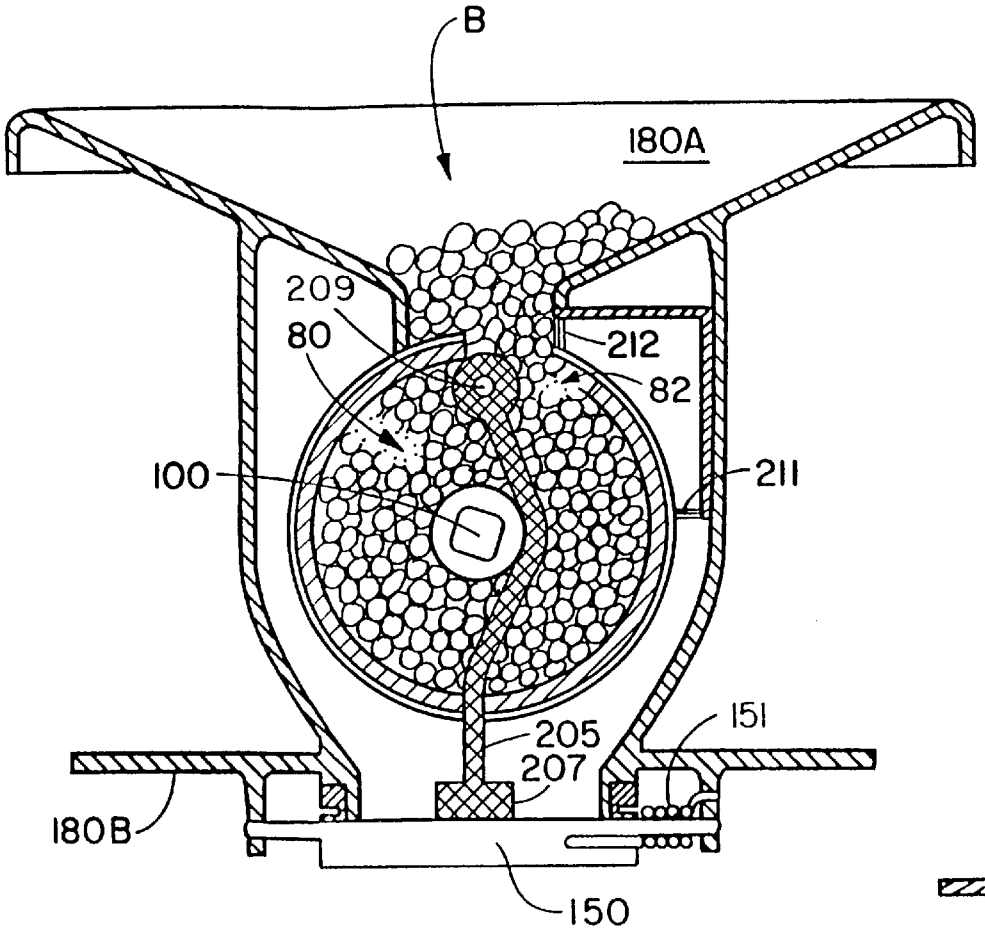

FIGS. 12A, 12B and 12C show for a second position of dispensing bin 80, a cross-sectional view of dispensing bin 80 rotated 15 degrees from its position in FIG. 11A, a schematic of supply valve assembly 130, and a schematic of dump valve assembly 120, respectively.

Figure 13B:
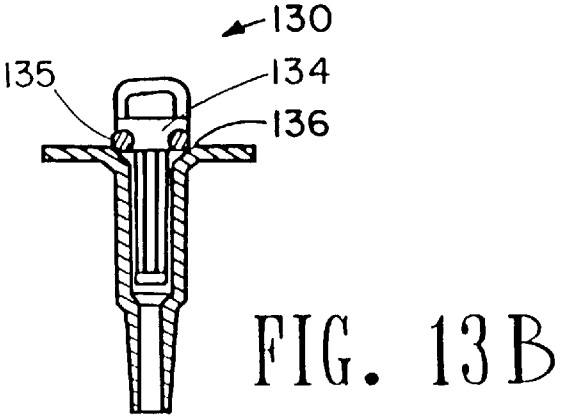
Figure 13C:
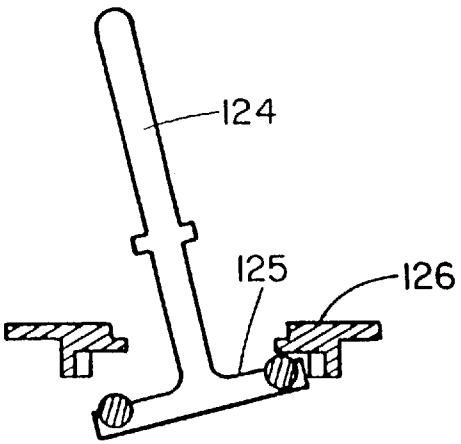
Figure 13A:
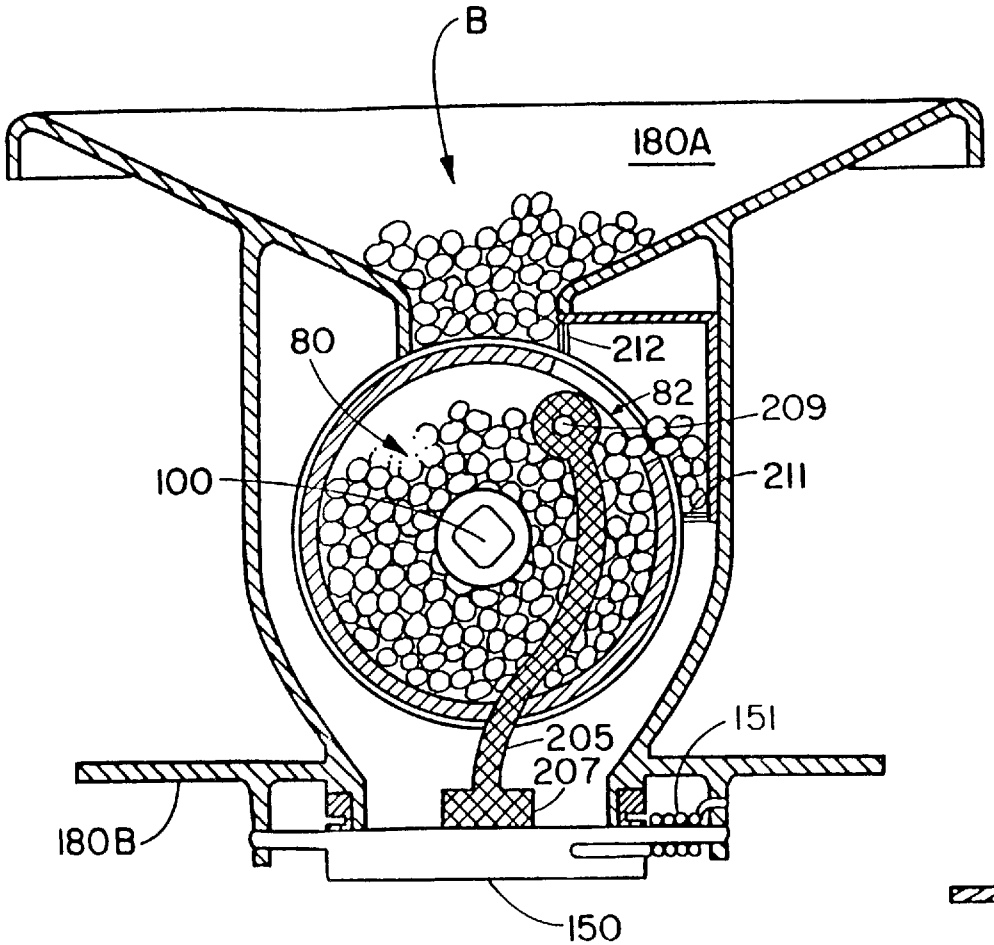

FIGS. 13A, 13B and 13C show for a third position of dispensing bin 80, a cross-sectional view of dispensing bin 80 rotated 45 degrees from, its position in FIG. 11A, a schematic of supply valve assembly 130, and a schematic of dump valve assembly 120, respectively.

Figure 14B:
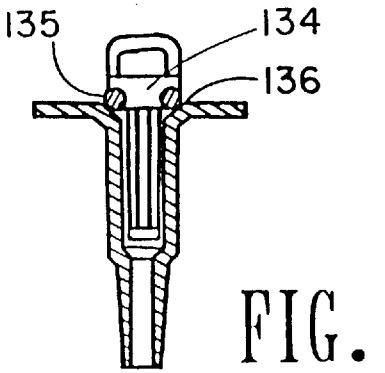
Figure 14C:
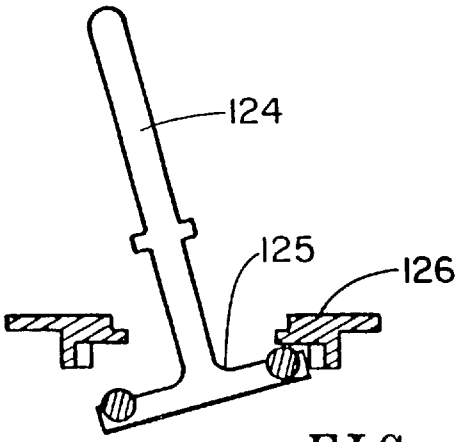
Figure 14A:
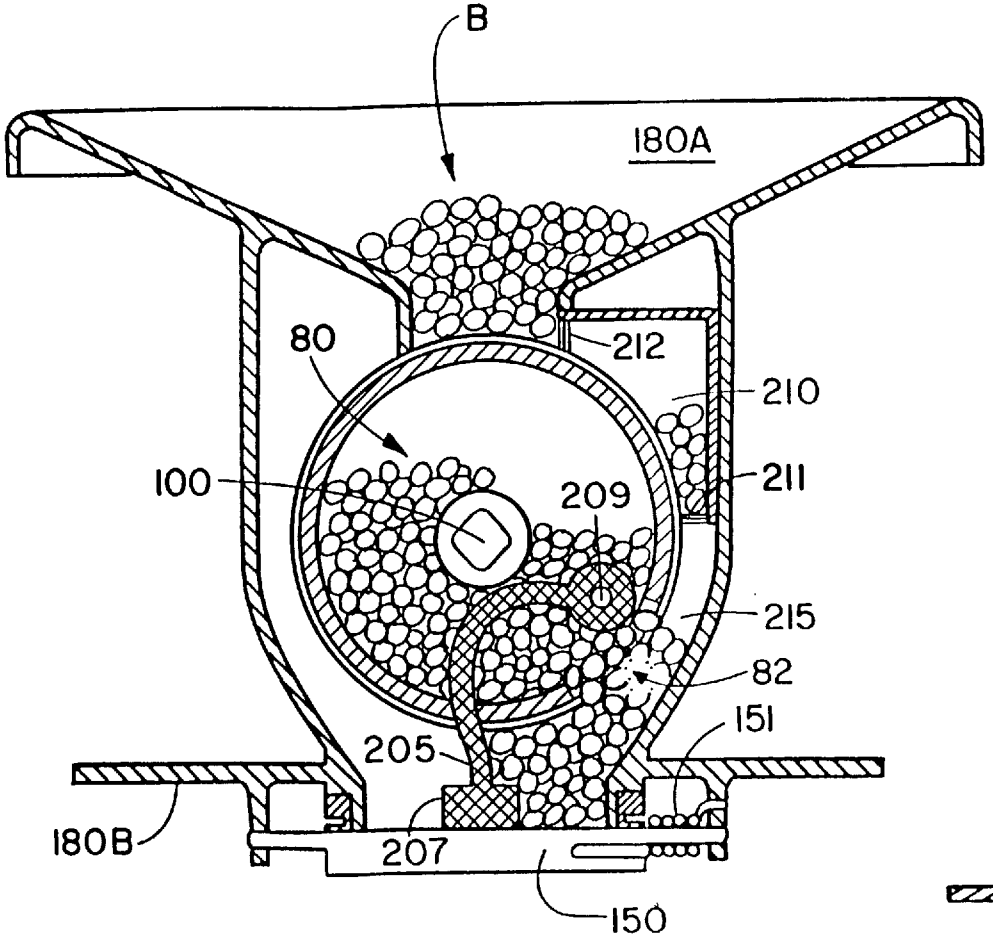

FIGS. 14A, 14B and 14C show for a fourth position of dispensing bin 80, a cross-sectional view of dispensing bin 80 rotated 120 degrees from its position in FIG. 11A, a schematic of supply valve assembly 130, and a schematic of dump valve assembly 120, respectfully.

Figure 15B:
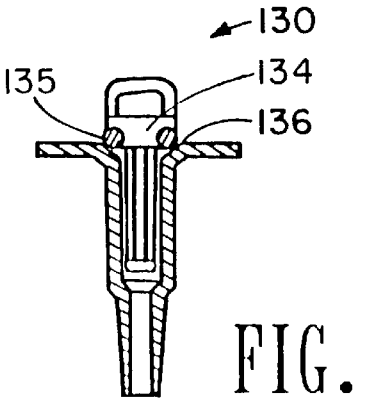
Figure 15C:
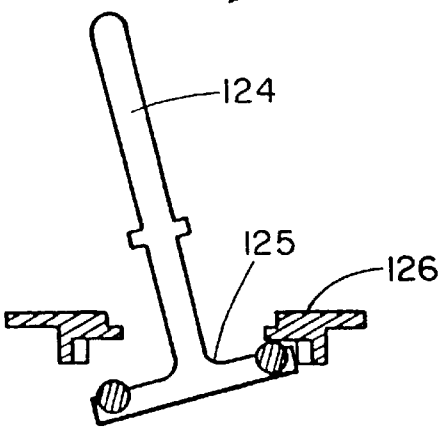
Figure 15A:
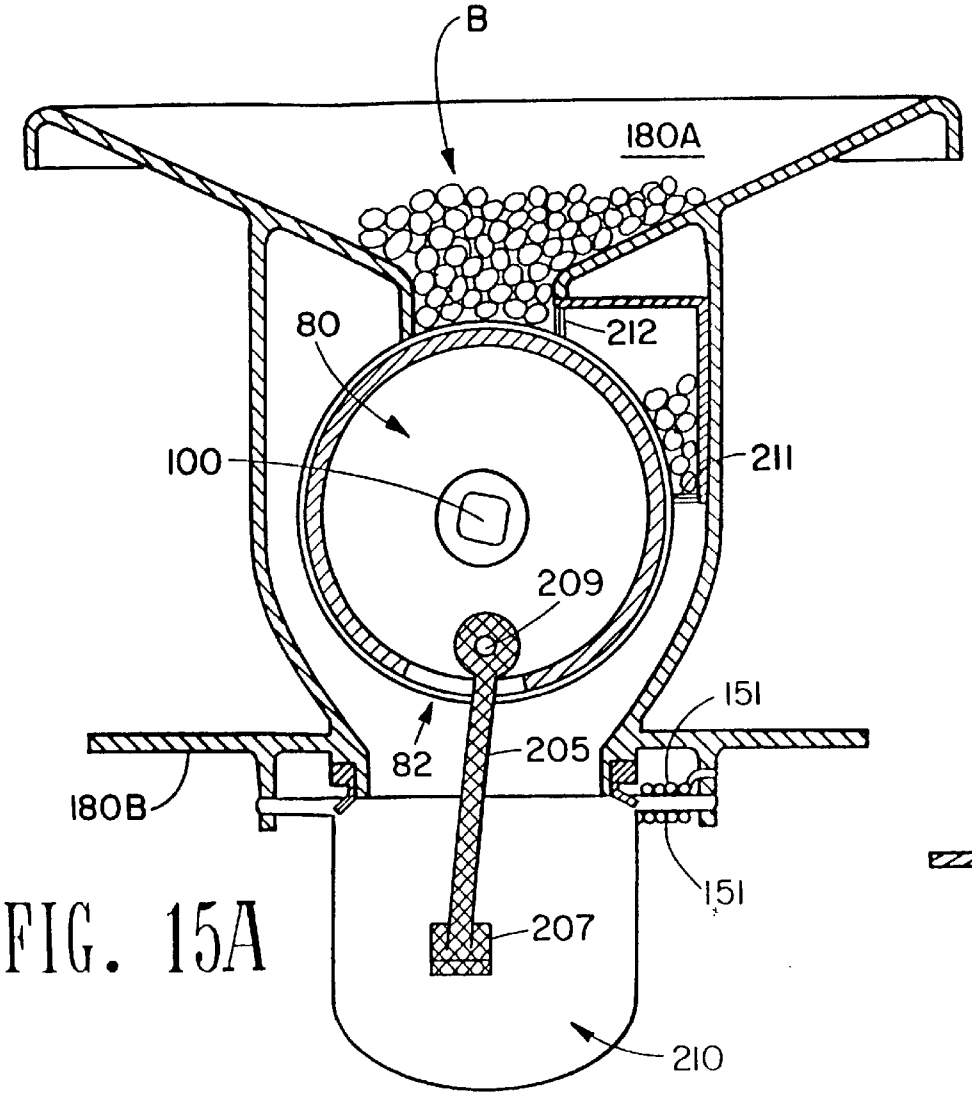

FIGS. 15A, 15B and 15C show for a fifth position of dispensing bin 80, a cross-sectional view of dispensing bin 80, fully rotated from its position in FIG. 11A, a schematic of supply valve assembly 130, and a schematic of dump valve 120, respectively.

Figures 16A, 16B, 16C:
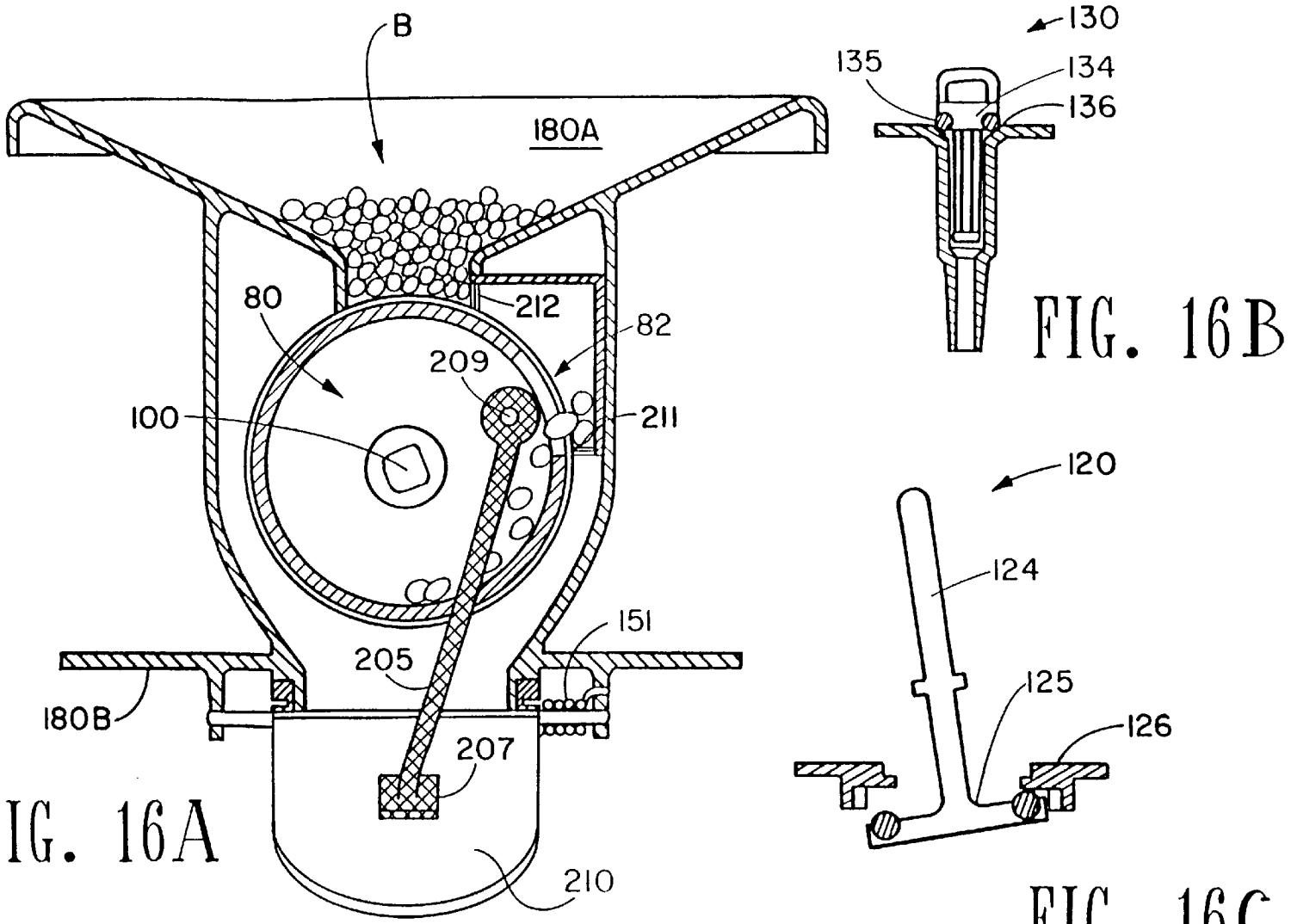

FIGS. 16A, 16B and 16C show for a sixth position of dispensing bin 80, a cross-sectional view of dispensing bin 80 in the process of returning back to its position in FIG. 11A with bin opening 82 adjacent to the lower portion of catchment 210, a schematic of supply valve assembly 130, and a schematic of dump valve assembly 120, respectively.

Figure 17B:
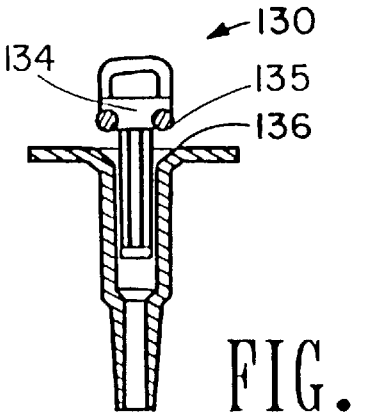
Figure 17C:
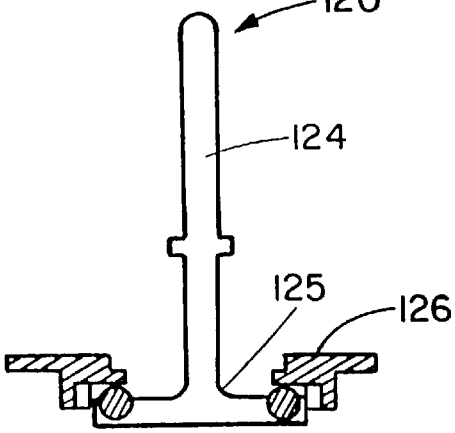
Figure 17A:
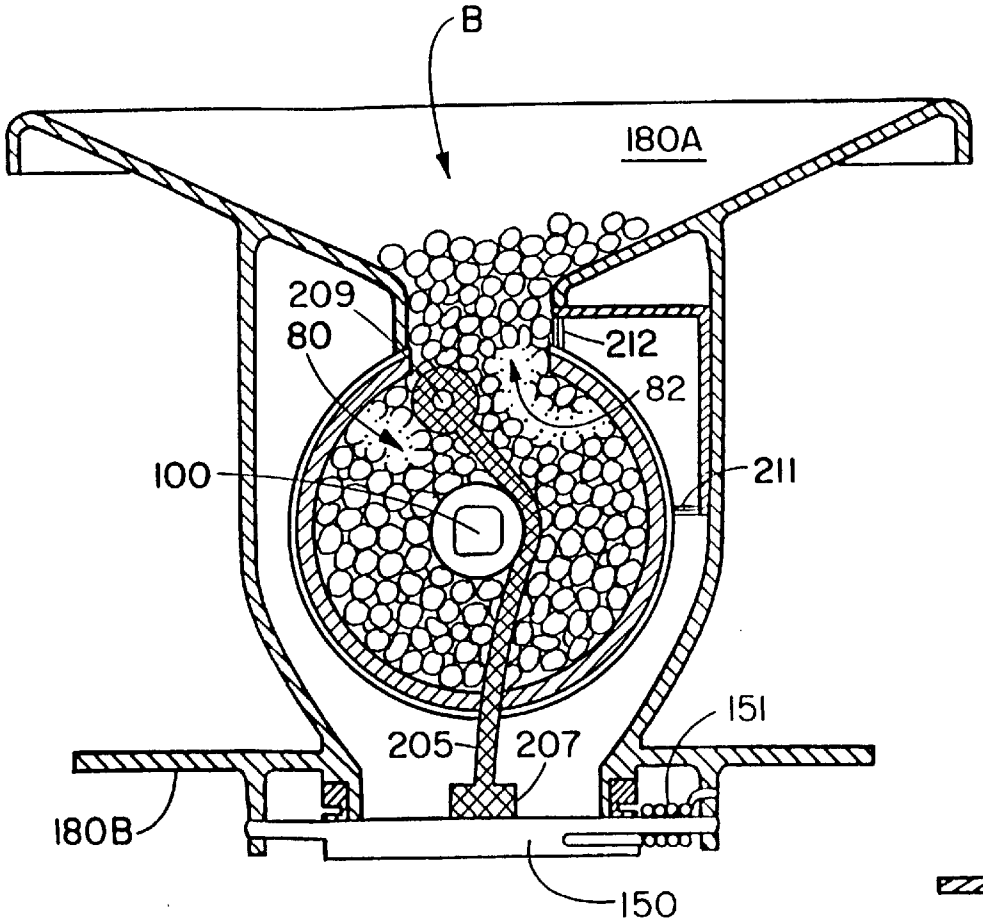

FIGS. 17A., 17B and 17C show for a seventh position of dispensing bin 80, a cross-sectional view of dispensing bin 80 returned back to its position in FIG. 11A with bin opening 82 adjacent to upper funnel 180A, a schematic of supply valve assembly 130, and a schematic of dump valve assembly 120, respectively.

Figure 18:
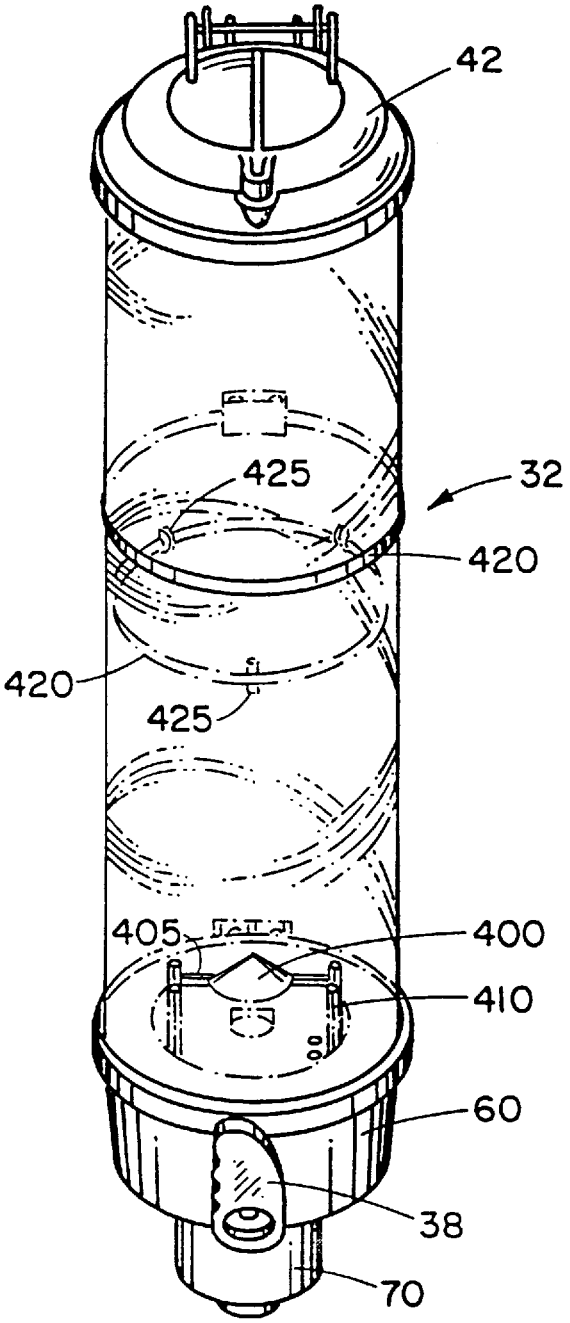

FIG. 18 shows inverted cone 400 positioned inside elongated cylinder 32.

It is to be noted that the drawings illustrate only some of the various embodiments of the present invention and are therefore not to be considered as limiting the scope of the claims, for the invention will admit to other equivalent embodiments.

DETAILED DESCRIPTION OF THE INVENTION

This invention generally relates to a vacuum storage and dispensing container for use with perishable items, particularly food products, and more particularly for use with roasted whole-bean coffee, to extend the shelf life of the perishable item for several months.

There is shown in FIG. 1 a pictorial view of a merchandising unit 10 illustrating the basic components of one embodiment of the apparatus of the present invention. Merchandising unit 10, which has a left side wall 11A, a right side wall 11B, and a rear wall 11C, may be made of any suitable materials. Non-limiting examples of preferred materials include, but are not limited to, particle board, wood or any other suitable type of supporting substrate, with a laminated finish, such Formica® brand laminate, Wilsonart® brand laminate or other high pressure laminate. Merchandising unit 10 may be of any suitable dimensions. Generally, the dimensions of merchandising unit 10 will be dictated by the necessary amount of storage volume required, and the display space provided. For example, in the embodiment as shown in FIG. 1, unit 10 is from about 4 to about 10 feet tall, from about 2 to about 8 foot wide, and from about ½ to about 2 feet deep.

Figure 2:
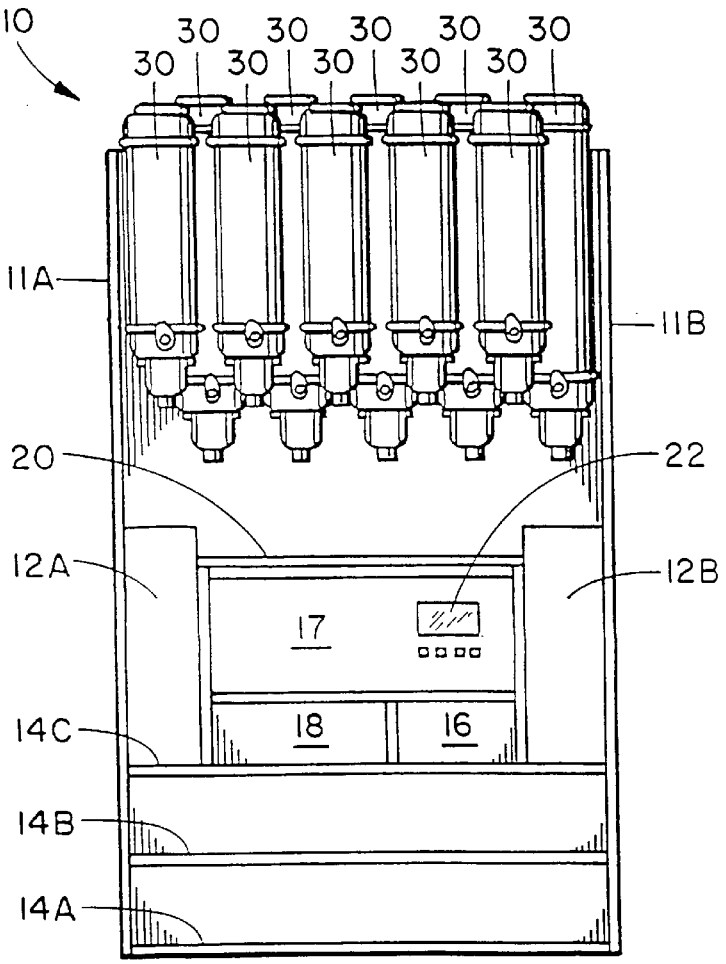

Near the bottom of the merchandising unit 10, there may optionally be provided one or more shelves, for example, shelves 14A, 14B, and 14C. Packages of ground and whole-bean coffee may be displayed for sale to the consumer and placed, for example, on top of the shelves 14A and 14B. The packages may be held in storage trays that have a spring or other device to keep the packages near the front of the unit for proper presentation. As shown in FIG. 2, shelve 14C may support one or more optional coffee grinders 12A and 12B, and an optional utility cabinet 20. Coffee grinders 12A and 12B are standard off-the-shelf models, one of which is used to grind unflavored coffee beans and the other to grind flavored coffee beans (to avoid flavor contamination of the unflavored coffee beans). Any suitable utility cabinet 20 may be optionally utilized. In the embodiment shown, utility cabinet 20 has three compartments 16, 17 and 18. Compartment 16 may hold smaller packages of ground and whole-bean, coffee presented in similar spring pusher trays. Compartment 17, which has a hinged door, stores a vacuum pump and associated mechanical devices to be discussed later. Compartment 18 may be used to store empty bags in which the customer may add coffee beans or ground coffee.

Near the top of the merchandising unit 10 are one or more vacuum storage and dispensing containers 30 filled with roasted whole-bean coffee.

To aid the consumer in the selection of coffee beans, utility cabinet 20 may have a consumer interactive component 22. A spill tray (not shown) may be placed on top of utility cabinet 20 to catch wayward coffee beans that fail to fall into a bag when released from the containers above.

Merchandising unit 10, shelves 14A, 14B and 14C, cabinet 20, and compartments 16, 17 and 18, may be manufactured from any suitable materials, non-limiting examples of which include a wide variety of materials, such as wood, steel, aluminum, plastic,, and the like. Further, merchandising unit 10 could be decorated and trimmed in many ways with the use of materials such as chrome, brass, gold, fascias, decorative laminates, or with advertising materials such as banners, stickers and displays. If desired, the merchandising unit could be provided with lighting or sound, or even a computer driven customer interactive feature. As is further illustrated in FIGS. 2–4, merchandising unit 10 includes one or more storage and dispensing containers 30. Each container 30 may be filled with the same or different type of coffee bean, for example, Brazilian coffee beans, Columbian coffee beans, or flavored coffee beans, in enough of a variety to pique the interest of the consumer. Since there is one type of bean per container 30, the products remain separated and can be dispensed separately. In the preferred embodiment illustrated in FIGS. 1–4, there are shown 10 containers, in two rows of 5 containers each, within a 4 foot wide merchandising unit 10. The number of containers 30, however, is not so limited, for the aspects of the present invention are as useful for one container 30 as for hundreds or thousands of containers 30. For example, 5000 containers 30 could be utilized. Merchandising unit 10 is very flexible in design. For another example, a single container for home use, as well as a double modular unit having 20 containers for industrial use, could be designed. FIG. 4 is one embodiment showing the arrangement of, vacuum lines 90, to be discussed below, exiting from the rear wall 11C of merchandising unit 10.

Alternatively, one or more containers 30 could be utilized apart from merchandising unit 10 in a variety of configurations, provided that suitable reduced pressure could be provided.

Turning now to FIGS. 5 and 6, there is shown an exploded front view and a left side view, respectively, of one container 30 of the present invention. To begin, the invention comprises a means for storing, under reduced atmospheric pressure, a product to be dispensed. For example, the storage and dispensing container 30 comprises a hollow container 32, an upper enclosure 40, and a lower enclosure 60. A dispensing snout 70, through which the coffee beans may flow, is attached to the lower end of the container 30. The dispensing snout 70 is designed to be of such a length and diameter that it would be difficult, if not impossible, for one to reach within its interior to tamper with the internal workings of the lower enclosure 60. The container 30 may also have means for diverting the product, such as a diverting tongue 72 attached to the dispensing snout 70.

It is important that elongated cylinder 32 be made of a material that is substantially impervious to the variety of flavorings seen in the increasingly popular gourmet coffee products. For example, the oils used in flavoring gourmet coffees, such as cinnamon, hazelnut, and amaretto flavorings, can tend to cause tiny crevices and cracks to develop over time in the plastics of the coffee bins and associated plastic machinery (a process called crazing). Preferably, cylinder 32 is transparent to provide a view of the coffee beans or food items to the purchasing customer. Accordingly, cylinder 32 may be made of different types of materials such as tempered glass, polycarbonate, acrylic plastics, or non-acrylic plastics such acrylonitrile butadiene styrene (ABS) plastics. Cylinder 32 is most conveniently extruded into a seamless tube.

Elongated cylinder 32 is dimensioned according to the desired amount of material to be stored. As a non-limiting example, as shown in FIGS. 5 and 6, cylinder 32 will nominally be from about 4 to about 12 inches in diameter, preferably 8 inches, and from about 10 to about 60 inches in height, preferably 30 to 36 inches. Again, it must be appreciated that cylinder 32 can be of any diameter and height, subject to a sufficient vacuum source and the amount of material to be stored. The inside of cylinder 32 is preferably somewhat smooth to facilitate material flow, and of uniform diameter. Cylinder 32 top and bottom are preferably covered with air-tight enclosures 40 and 60. Alternatively, storage container 32 may be any air-tight enclosure of any suitable regular or irregular geometric shape that is capable of holding the product to be dispensed. Non-limiting examples of suitable shapes include spherical, cylindrical, conical, or rectangular enclosures, which may be made of a variety of materials suitable for the product being stored and the vacuum conditions desired. If a removable sealed joint were provided between cylinder 32 and lower enclosure 60, cylinder 32 would not need a top opening and upper enclosure 40 could be eliminated.

Also shown in FIGS. 5 and 6 is a handle or knob 38 which the shopper uses to activate the system. While handle 38 may be of any suitable shape, in the embodiment as shown, handle 38 is curved and has several indentations to provide a tactile gripping surface. While its dimensions and positioning may vary greatly, in the embodiment as shown, handle 38 is from about 1 to about 3 inches tall and from about ½ to about 2 inches wide, and is located from about ½ to about 1 inch from the exterior of the lower enclosure 60.

An inverted cone 400, shown in FIG. 18, is positioned within the cylinder 32 attached to the lower enclosure 60 above the dispensing opening by horizontal supports 405 and or vertical supports 410. Also positioned within cylinder 32 are reinforcements 420 supported by reinforcement clips 425. The inverted cone 400, with its point up, causes the coffee beans located at the center of the cylinder 32 to be diverted to the sides for even product rotation. As such, the coffee beans first added to the cylinder are first fed into the portion control bin 80 for customer use.

Attached to the top end of the cylinder 32 is an upper enclosure 40 having a lid or cap 42 which can be removed so that the coffee beans may be poured into the cylinder. In fact, whole roasted coffee beans that were packaged at a coffee roasting plant may be opened and poured into a cylinder at the retail site. Cylinder 32 may be filled full with coffee beans or to any smaller portion thereof. A seal 44A, non-limiting examples of which include flat gasket, O-ring, U-cup, V-ring, or other suitable seal, forms a secure seal with lid 42 and upper enclosure 40. Preferably, seal 44A is a U-cup. In the operating or vacuum state, it is apparent that the need for a locking lid has been eliminated since the vacuum locks the lid on automatically. For additional security, however, for example when the vacuum is off, it is generally desired that a locking mechanism be provided to secure lid 42 in place. FIG. 7A is a top view of container 30 showing handle 38, upper enclosure 40, lid 42, and seal 44A.

Attached to the bottom end of cylinder 32 is a lower enclosure 60 to which the dispensing snout 70 is attached. Referring additionally to FIG. 8, this dispensing snout 70 can also be attached to lower chassis plate 180B. Upper and lower enclosures 40 and 60 are circumscribed by depending flange 50A and 50B, respectively, forming channels 50AC and 50BC resptively, arranged to receive the top and bottom ends of cylinder 32. In assembly, an elastomeric or similar compound is provided in channels 50AC and 50BC, to both seal and affix to cylinder 32 to upper and lower enclosures 40 and 60. Disposed alternatively, but less preferred, around the outer circumference of the upper and lower enclosures is a flat gasket or O-ring 64A and 64B, which in the operative manner, sets upon the inside of and forms a secure seal with cylinder 32. Of course, elastomeric compounds are excellent choices for the seal or gasket material. They store elastic energy, conform to fit surface irregularities, and are resistant to many chemicals. FIG. 7B is a bottom view of container 30 showing handle 38, lower enclosure 60, dispensing snout 70, and O-ring 44B.

Upper and lower enclosures 40 and 60 are sized to properly fit cylinder 32. In the embodiments shown, they will normally be from about 4 to about 12 inches in diameter, preferably 8 inches, and from about 2 to about 8 inches in height, preferably 5 inches. Upper and lower enclosures 40 and 60 may optionally taper inward at the ends not connected to the cylinder 32 to a diameter less than the diameter of the cylinder, preferably with a draft angle in the range of about 1 to about 10 degrees. The enclosures may be made of any suitable material, by any suitable method, for example, from plastic, or from metals, by appropriate forming, fabrication or manufacturing techniques. A vacuum line 90 is shown passing through an aperture in dispensing snout 70 of container 30 in FIG. 6. As described below in connection with FIG. 8, vacuum line 90 is attached to connector piece 91 which communicates with the interior of lower enclosure 60. Accordingly, each container 30, and its respective cylinder 32, in which the perishable items are stored, are in fluid communication, with the vacuum system of the present invention.

A first embodiment of dispensing assembly 200 is shown in FIG. 8, with a preferred embodiment of dispensing assembly 200 shown in FIG. 9.

Referring first to FIG. 8, there is shown is a cross-sectional view of shaft 100, portion control bin 80, valves and cams, and dispensing door 150 of an embodiment of the present invention. The working parts, to be discussed below, are mounted upon lower chassis plate 180B having vertical supports 182 and 184, all of which are contained within lower enclosure 60 of container 30. Positioned below elongated cylinder 32 is upper funnel 180A. As discussed below, the coffee beans held in cylinder 32 may flow through an opening in the upper funnel 180A into portion control bin 80. Similarly, below and attached to lower chassis plate 180B is dispensing snout 70. As discussed below, coffee beans held in portion control bin 80 may flow through an opening in lower chassis plate 180B into dispensing snout 70.

A major driving element of the dispensing system 10 is rotary shaft or axle 100. While shaft 100 may be made of any suitable material, it is preferably made of aluminum, polycarbonate, fiberglass-filled polycarbonate, stainless steel, or other metals and materials. Rotary shaft 100 has a diameter from about ¼ to about ½ inch and a length somewhat longer than the diameter of the lower enclosure 60, preferably, about 8 inches.

One end 102 of shaft 100 is attached to handle or knob 38, which the shopper uses to activate the system. The other end 104 of shaft 100 resides within a retainer seat or bearing housing (not shown) attached or integrally molded to the inner wall of the lower enclosure 60. Handle 38 should be removable to allow disassembly of unit 10, and for example, may be glued, pop riveted, screwed, bolted, "key-wayed," or otherwise removably connected to end 102 of shaft 100.

A boss 112, which includes an O-ring gland or a seat for a "U" cup may be attached or integrally molded to the outer wall of lower enclosure 60 to provide a seal where end 102 of shaft 100 exits the enclosure for handle 38. As discussed above, since shaft 100 is longer than the diameter of lower enclosure 60, shaft 100 extends through the lower enclosure to provide an end 102 to which handle 38 may be connected. Attached to shaft 100 is a portion control bin or dispensing cup 80, a return helper spring (not shown), a cam 122 to activate a dump valve assembly 120, and a cam 132 to 30 activate a vacuum-line shut off valve assembly 130. Shaft 100 is supported by two in-line bearings 106 and 108 which keep shaft 100 running "true" or straight. A connecting linkage 140, which opens and closes dispensing door 150, is attached to the side of portion bin 80.

During the removal or restocking of the product, the pressure differential must be eliminated, which can be easily accomplished by shutting off the vacuum pump. Alternatively, dispensing container 30 also comprises a mechanism, such as vacuum dump valve assembly 120, for temporarily eliminating the pressure differential during the removal or restocking of the product from the storage container. Dump valve assembly 120 is a poppet-style valve in the back of the unit. This dump valve assembly 120 has a valve stem 124, valve plate 125, valve seat 126, and return spring 128. Valve stem 124, valve plate 125, and valve seat 126 may be separate, or may be molded as composite pieces, and in the embodiment shown are an assembly of molded pieces. The atmosphere is in fluid communication with the valve seat 126. Dump valve assembly 120 is activated by a cam 122 on main shaft 100. When container 30 is "closed," stem 124 of dump value assembly 120 is standing straight up.

Because the valve plate 125 is "seated" on top of the valve seat 126, no air is allowed into the container 30. As the shopper turns handle 38, which is attached to end 102 of shaft 100, clockwise, cam 122 pushes valve stem 124 of dump valve assembly 120, thereby repositioning valve plate 125 off of valve seat 126. This breaks the vacuum by allowing air to enter the container 30. Without the dump valve, the shopper would not be strong enough to break the vacuum seal of the container. If desired, this feature can be used to prevent theft or unauthorized access to the contents of the storage and dispensing container 30. As such, the dispensing container may further comprise a means for selectively inhibiting the means for removing a portion of the product from the storing means. For example, valve assembly 120 can be blocked from operating until enabled, perhaps as a result of payment for the product. When the shaft 100 is returned to its closed position, the cam 122 stops pressing on the valve stem 124, and the return spring 128 straightens up the valve stem 124. This reseats the valve plate 125, and prevents additional air from entering the container 30.

Dispensing container 80 also comprises a mechanism for creating and maintaining a pressure differential within the storing means. For example, a vacuum-line shut off valve assembly 130 is also built into the bottom of the unit. The vacuum-line shut off valve has a valve stem 134, valve plate 135, valve seat 136, and return spring 138, two guide posts 131, valve face 137 and a suspension spring 139. A vacuum line 90, via elbow piece 91, is in fluid communication with the valve seat 136. The vacuum-line shut off valve is a compression-type valve. When the container 30 is "closed," the valve face 137 is not "seated" on the valve seat 136. As such, a vacuum may be created within the container 30. As the shaft 100 is turned clockwise, a cam lobe 132 presses the valve plate 135 down, which causes it to descend along its guide posts 131. This moves the valve stem 134 and valve face 137 down, compressing valve suspension spring 139, compressing return springs 138, and pressing valve face 137 against valve seat 134. This seals off or shuts off vacuum line 90 and isolates the container 30. When main shaft 100 is returned to the closed position, cam lobe 132 allows valve plate 135 to rise, decompressing return springs 138, decompressing valve suspension spring 139, and lifting the valve stem 134 and valve face 137 from valve seat 136, re-establishing vacuum communication between container 30 and vacuum line 90.

A return helper spring 114 is also attached to rotary shaft or axle 100. This spring is intended to assist the consumer by helping close dispensing door 150 and returning main shaft 100 to the closed position when the consumer has concluded shopping. A connecting rod or tension cable 140, such as a small steel wire, is connected to dispensing door 150 on one end and to portion control bin 80 on the other end. Connecting rod 140 pulls the dispensing door shut as main shaft 100 is returned to the closed position. In another embodiment, connecting rod 140 could be replaced by a chain. If connecting rod 140 is replaced by a flexible element, it is necessary to incorporate an opening spring 151 into the door 150 design. Such an opening spring 151 is shown in FIG. 8. Dispensing door 150 must shut tightly to form a perfect seal to maintain the vacuum conditions within cylinder 32. As such, there must be a seal 450 to which dispensing door 150 abuts when closed. Dispensing door 150 pivots on an axis defined by pivots points on two hinge posts molded to lower chassis plate 180B.

In even another embodiment (to be discussed in more detail below and by reference to FIGS. 11–17) connecting rod 140 could be replaced by a flexible link.

In general, the removal mechanism of the dispensing container may comprise a portion control bin for holding a portion of the product, having a chamber and an opening in fluid communication therewith, and a means for moving the holding means, such as a rotary shaft, from a feeding position, where the product enters the chamber through the opening, to a dispensing position, where the product exits the chamber through the opening.

The portion control bin or dispensing cup 80 is optionally a "floating drum" on the main shaft 100 that could be one molded piece or two or more pieces affixed or joined together. Although portion control bin 80 is depicted as a cylinder or drum, it could also comprise a dispensing cup or cone that is not cylindrical, that is, of any suitable regular or irregular geometric shape. The portion control bin has a suitable opening or slit 82, which, when in he closed or feeding position, is closest to upper funnel 180A and to the bottom of cylinder 32, such that the whole-bean coffee may fall through the opening in upper funnel 180A, through portion control bin opening 82, and into portion control bin 80. Portion control bin 80 is designed to hold a certain volume of the perishable item being dispensed, and in the embodiment as shown the bin size will hold approximately ¼ lb. of whole bean coffee. When the customer turns handle 38 which is attached to end 102 of shaft 100, which in turn is attached to portion control bin 80, the bin rotates clockwise toward the lower chassis plate 180B and toward dispensing snout 70. Small opening 82 of portion control bin 80 will then be directly above the now opened dispensing door 150 to a dispensing position, so that the pre-measured amount of the perishable item may flow through the opening in lower chassis plate 180B, through dispensing snout 70, and into the customer's bag. If desired, the unit can have a "clutch" built into the portion control bin. With such an optional clutch, main shaft 100 can be allowed to turn a certain amount, for example in the embodiment shown, approximately fifteen degrees (15°), before portion control drum 80 starts turning. However, valves 120 and 130 can be activated and dispensing door 150 can begin opening immediately.

A stop 84 is attached to the top of portion control bin 80 near opening 82. The stop aligns opening 82 of portion control bin 80 with the opening in the upper funnel 180A for the closed position, and aligns opening 82 with the opening in lower chassis plate 180B for the opened position. Stop 84 is provided to limit the rotation of portion control bin to a desired amount, which in the embodiment shown is approximately one hundred eighty degrees (180°). Optional removal of stop 84 allows portion control bin 80 to rotate 360° thus eliminating the need for a return spring. Of course, if the bin is to revolve 360 or more degrees, mechanisms such as a lifting cam or crankshaft, will need to be provided to lift and lower the door link and to prevent it from wrapping around the shaft. In alternative embodiments, stop 84 may be attached elsewhere, for example, to the side of portion control bin 80 or on shaft 100.

In another embodiment, to keep chaff and beans from getting caught between portion control bin 80 and upper funnel 180A and lower chassis plate 180B in which it rotates, a series of extending flexible members, such as finger-like projections or brushes, can be included to direct coffee beans into portion control bin 80, and to prevent beans from leaking around the portion bin 80 during operation. In alternative embodiments, the metered dispensing system described above could be replaced by any suitable positive shut-off system to control bean flow, such as a spring-loaded door, rotary air lock, cylinder valve and the like.

The preferred embodiment of dispensing assembly 200 will now be described by reference to FIG. 9, in which there is shown a cross-section view of cylinder 32, lower enclosure 60, rotary shaft 100, portion control bin 80, and lower chassis plate 180B. For ease in viewing, the valves described above have been removed. Cylinder 32 rests within flange 50B of lower enclosure 60, and is attached to lower enclosure 60 with an elastomeric joint. Portion control bin 80 with its opening 82 is attached to the rotary shaft 100. Further, there is a top funnel 187 and a directing funnel 186 near the top of lower enclosure 60 for facilitating direction of the perishable items held within cylinder 32, such as coffee beans, into small opening 82 of portion control bin 80.

Portion cup 80 and cam assembly 110 are supported by bearings 106 and 108, which are a part of lower chassis plate 180B. This lower chassis plate 180B has an opening or discharge port 190 through which the perishable items may exit lower enclosure 60. A seal or gasket 194 is positioned between and forms a seal between the lower chassis plate 180B and lower enclosure 60, which plate and enclosures are held together by a plurality of connectors 196.

Several of the components of the storage and dispensing container 30 may be removed and disassembled for routine maintenance. With the vacuum conditions released, the dispensing snout 70 and dispensing door 150 can be removed from lower chassis plate 180B. Similarly, handle 38 can be removed from portion cup 80. Screws 196 can be unscrewed from lower chassis plate 180B. Lower chassis plate, rotary shaft, portion control bin, valves and cams can then be removed from the bottom of the lower enclosure as an assembly.

Referring now to FIGS. 11–17, there is shown the flexible link embodiment of the present invention. Upper funnel 180A provides beans B through bin opening 82 to portion control bin 80. Flexible link 205 is connected to dispensing door 150 by connector 207, and slips over a pin molded to the portion control cup. Rotation of portion control bin 80 by handle 38, causes the positioning of bin opening 82 from adjacent upper funnel 180A, to and then past catchment 210. This catchment 210 is formed by the deployment of two brushes 211 and 212. The upper brush 212 is mounted to upper funnel 180A at the side of opening 82 in the direction of rotation. Lower brush 211 is mounted at approximately the 90 degree position in the direction of rotation when unloading. Catchment 210 is the space between these two brushes.

FIGS. 11A, 11B and 11C show for a first position of dispensing bin 30, a cross-sectional view of dispensing bin 80, a schematic of supply valve assembly 130, and a schematic of dump valve assembly 120, respectively. In this first position, flex link 205 is in a somewhat stretched position around the rear hub of bin 80, and provides enough tension to have returned door 150 to the closed position. Supply valve 130 is open. Dump valve assembly 120 is closed.

FIGS. 12A, 12B and 12C show for a second position of dispensing bin 80, a cross-sectional view of dispensing bin 80 rotated 15 degrees from its position in FIG. 11A, a schematic of supply valve assembly 130, and a schematic of dump valve assembly 120, respectively. In this second position, flex link 205 is in a very slack position(notice that dispensing door 150 is retained in the closed position by the system vacuum). Supply valve assembly 130 is closed. Dump valve assembly 120 is shut.

FIGS. 13A, 13B and 13C show for a third position of dispensing bin 80, a cross-sectional view of dispensing bin 80 rotated 45 degrees from, its position in FIG. 11A, a schematic of supply valve assembly 130, and a schematic of dump valve assembly 120, respectively. In this third position, flex link 205 is in an even less stretched position around shaft 100 (as explained above, dispensing door 150 is retained in the closed position by the system vacuum). Notice also that bin opening 82 is now adjacent catchment 210, thus allowing for a portion of beans B to have spilled into catchment. Supply valve assembly 130 is closed. Dump valve assembly 120 has been opened by dump valve cam 122. At this point, air is generally entering with a loud whoosh.

FIGS. 14A, 14B and 14C show for a fourth position of dispensing bin 80, a cross-sectional view of dispensing bin 80 rotated 120 degrees from its position in FIG. 11A, a schematic of supply valve assembly 130, and a schematic of dump valve assembly 120, respectfully. In this fourth position, flex link 205 is now bent into an "S" form. The door may still be held shut by residual vacuum, and beans are beginning to spill out of the drum. Consequently, some beans B are trapped in catchment 210, and a portion has spilled out of portion control bin 80 and into staging area 215. Supply valve assembly 130 is closed. Dump valve assembly 120 has been opened even further by dump valve cam 122. At this point, the velocity of the air passing through dump valve 120 is greatly diminished.

FIGS. 15A, 15B and 15C show for a fifth position of dispensing bin 80, a cross-sectional view of dispensing bin 80, fully rotated from its position in FIG. 11A, a schematic of supply valve assembly 130, and a schematic of dump valve assembly 120, respectively. In this fifth position, the release of the vacuum, the weight of beans B in staging area 215 on dispensing door 150, and the bias of the door opening spring, have conspired to cause door 150 to open and allow beans B to drop. Flex link 205 is extended by opened dispensing door 150. Supply valve assembly 130 is closed. Dump valve assembly 120 has been fully opened by dump valve cam 122. At this point, there is no air flow.

FIGS. 16A, 16B and 16C show for a sixth position of dispensing bin 80, a cross-sectional view of dispensing bin 80 in the process of returning back to its position in FIG. 11A with bin opening 82 adjacent to the lower portion of catchment 210, a schematic of supply valve assembly 130, and a schematic of dump valve assembly 120, respectively. In this sixth position, the trapped beans in catchment 210 drop into and are recovered by portion control bin 80. Notice also that flexible link 205 is lifting dispensing door 150 back into position against door opening spring. Supply valve assembly 130 is still closed. Dump valve assembly 120 begins to close.

FIGS. 17A, 17B and 17C show for a seventh position of dispensing bin 80, a cross-sectional view of dispensing bin 80 returned back to its position in FIG. 11A with bin opening 82 adjacent to upper funnel 180A, a schematic of supply valve assembly 130, and a schematic of dump valve assembly 120, respectively. In this seventh position, a new portion of beans B have dropped through upper funnel 180A and now reside in portion control bin 80. Supply valve assembly 130 is open. Dump valve assembly 120 is closed.

Turning now to FIG. 10A there is shown a schematic diagram of an alternative embodiment of the vacuum system of the present invention. A vacuum line 40 is connected to each container 30. To prevent cross contamination of coffee flavors or aromas, there is one in-line check valve 164 per container. These check valves 164 are one-way valves which do not let air into containers 30 from vacuum lines 40. Vacuum lines 40 from the front row of the 5 containers 30 are joined together with T-connectors 48 to form one vacuum line 92. Similarly, vacuum lines 40 from the back row of the 5 containers 30 are joined together with T-connectors 48 to form one vacuum line 94. Then, front vacuum line 92 and back row vacuum line 94 are joined together with T-connector 49 to form one vacuum line 46, which is in fluid communication with vacuum pump 160. The front vacuum lines may optionally be "hidden" within a decorative panel and are branched out to each individual container 30. The rear vacuum lines are "hidden" behind the rear wall 11C of the merchandising unit 10. For convenience, vacuum lines 40 may be secured to the rear wall 11C of unit 10 with fasteners. There is also a one-way check valve 165 positioned upstream from vacuum pump 160, to further maintain the vacuum.

Turning now to FIG. 10B there is shown a schematic diagram of the preferred embodiment of the vacuum system of the present invention. Manifold 300A is attached to surge tank 307 by lines 311, and Manifold 300B is attached to surge tank 307 by lines 315, and each include a sufficient number of inlets to accommodate the containers 30. Check valves 301A and 301B, positioned in lines 311 and 315, respectively, serve to isolate manifold 300A from 300B. Solenoid valve 310 acts as a one way check valve located upstream of surge tank 307 to help maintain the vacuum. Optional air bleed valve 165, positioned between vacuum pump 160 and solenoid valve 310, may be required depending upon safety requirements and pump 160 specifications. Vacuum sensor switch 162 controls solenoid 310 and pump 160, depending upon the differential pressure.

Vacuum pump 160 can be any suitable vacuum source, mechanical or otherwise, having the capacity for creating a pressure differential in container 30. Nonlimiting examples of vacuum pump 160 include a piston pump, rotary pump, linear pump, diaphragm pump, linear diaphragm pump, gear pumps, screw pumps, as well as any other type of mechanical pump device.

In general, the dispensing container may further comprise detectors for detecting and recreating the pressure differential within the storage container. For example, vacuum pump 160 is connected to a pressure switch 162 that triggers the "turning off, or "turning on" of vacuum pump 160. When pressure switch 162 senses either a lack of vacuum or insufficient vacuum in the vacuum line, it actuates a switch, thereby sending a signal that opens solenoid valve 310 and activates vacuum pump 160, which recreates the vacuum in the system. When the vacuum in the system reaches a preset level, pressure switch 162 sends a signal that closes solenoid valve 310, deactivates vacuum pump 160.

It may be desired to measure and display the changes in the pressure of the air with a mechanical pressure gauge 172. The simplest mechanical gauges that can be used are the diaphragm gauge, Bourdon gauge, and capacitance manometer. Of course, a variety of direct and indirect gauges may be used to measure the reduced pressures of the particular vacuum system being used. The vacuum or pressure differential created within the storing means, measured between the pressure inside the storing means and the pressure outside the storing means, should be in the range of from above 0 inches of mercury (Hg) column to about 29.9 inches of mercury (Hg) column, and preferably about 11 to 17 inches of mercury (Hg) column. Vacuum pump 160, display gauge 172, pressure switch 162, and solenoid 310 are hidden from view, enclosed-within compartment 17 of utility cabinet 20. If desired, compartment 17 may be covered or lined, with noise-reducing materials. Vacuum pump 160 is contained within one unit. It is contemplated that vacuum pump 160 may be varied in intensity according to the desires of the container owner, and like switch 162, can be purchased as an off-the-shelf item. While any suitable electrical power source may be utilized, most conveniently, the power source utilized is a standard electric alternating current (A/C) source 174.

In another aspect of this invention, there is provided a consumer interactive component 22, which can be attached on or within the door of compartment 17, that aids the consumer in the selection of coffee beans. In one embodiment, consumer interactive component 22 comprises a screen with touch pads or push buttons and selective dialogue, similar to the components of a typical automated teller machine. In another embodiment, component 22 could also include a digital voice device which can provide dialogue concerning the particular coffee bean or coffee blend selected, be it flavored coffees, unblended varietals, or blended varietals.

In the use of this invention, lid or cap 42 or, upper enclosure 40 is removed and the perishable item is poured into cylinder 32. Lid 42 is replaced and cylinder 30 is then maintained under a vacuum by pump 160 which is connected to cylinder 30 by vacuum lines 90, 92 or 94, and 96, After selecting the particular perishable item desired, the consumer turns knob 38, which allows dispensing door 150 to open. This knob 38, which is attached to portion cup 80, causes shaft 100 to rotate, and thus turning cam 122. This cam 122 moves the dump valve assembly 120, which opens the container to the atmosphere, allowing air to enter the cylinder 30, and allowing the atmosphere into the cylinder. The perishable item, such as coffee beans, flow out through dispensing snout 70 into the customer's bag. With the assistance of return spring 114, rotary shaft 100 and dispersing door 150 are then returned to a closed position. A pressure switch 162 notes the lack of vacuum and triggers vacuum pump 160 such that the vacuum conditions are recreated to maintain the freshness of the perishable item. With this construction, a vacuum is maintained between dispensing cycles so that no outside air comes in contact with the perishable item so as to cause its deterioration and no foreign matter can come into contact with the perishable item.

While the device has been described particularly for use with roasted whole-bean coffee, it is evident that the vacuum storage and dispensing container could be used for a variety of food products or perishable items where extended shelf life is desirable. As such, the invention is capable of broad application and is readily adaptable to other fields, uses, and applications. Also note that in some situations containers 30 may be operated at atmospheric pressure, and in such a situation, the principles of this invention can be used.

Although the present invention and its advantages have been described in detail, it should be understood that various changes, substitutions and alterations can be made herein without departing from the spirit and scope of the invention as defined by the appended claims.

What is claimed is:

1. A dispensing apparatus comprising:

at least one container for storing, under reduced atmospheric pressure, product to be dispensed;

a pressure reducing mechanism in communication with the container, for creating and maintaining a pressure differential within said container, said differential measured between the pressure inside and outside of said container;

a product dispensing mechanism, activated and controlled by a user, for initiating temporary elimination of said pressure differential and for dispensing a portion of said product from said at least one container, a valve mechanism, operably associated with said product dispensing mechanism, for sequentially temporarily eliminating said communication between the pressure velocity mechanism from the container, temporarily, eliminating, said pressure differential, and dispensing said portion of said product; and a flexible linkage, operably associated with said product dispersing mechanism and said valve mechanism, for closing said product dispensing mechanism and permitting restoration of said pressure differential.

2. The dispensing apparatus of claim 1 wherein the container is a cylinder.

3. The dispensing apparatus of claim 1 wherein the pressure reducing mechanism is selected from among piston pumps, rotary pumps, linear pumps, diaphragm pumps, linear diaphragm pumps, gear pumps, and screw pumps.

4. The dispensing apparatus of claim 1 comprising in the range of about 1 to about 5000 containers.

5. The dispensing apparatus of claim 1 comprising in the range of about 4 to about 20 containers, wherein each container is a cylinder, and wherein the pressure reducing mechanism is selected from among piston pumps, rotary pumps, linear pumps, diaphragm pumps, linear diaphragm pumps, gear pumps, and screw pumps.

* * * * *